US005284112A

United States Patent [19]

Takehara et al.

[11] Patent Number: 5,284,112

[45] Date of Patent: Feb. 8, 1994

[54] VALVE OPERATING MECHANISM INCLUDING VALVE LIFTER

[75] Inventors: Takeichiro Takehara, Yokohama; Yoshiki Muto, Zama, both of Japan

[73] Assignee: Nissan Motor Co., Ltd., Yokohama, Japan

[21] Appl. No.: 34,369

[22] Filed: Mar. 19, 1993

[30] Foreign Application Priority Data

Apr. 6, 1992 [JP] Japan ..... 4-083624

[51] Int. Cl.[5] ..... F01L 1/14

[52] U.S. Cl. ..... 123/90.48; 123/90.51; 74/569

[58] Field of Search ..... 123/90.48, 90.49, 90.5, 123/90.51, 90.52; 74/569

[56] References Cited

U.S. PATENT DOCUMENTS

| | | | |
|---|---|---|---|
| 3,675,631 | 7/1972 | Hixson | 123/90.52 |
| 4,367,701 | 1/1983 | Buente | 123/90.51 |
| 4,430,970 | 2/1984 | Holtzberg et al. | 123/90.51 |
| 4,643,144 | 2/1987 | Fingerle et al. | 123/90.49 |

FOREIGN PATENT DOCUMENTS

| | | | |
|---|---|---|---|
| 3415228 | 10/1985 | Fed. Rep. of Germany | 123/90.51 |

*Primary Examiner*—E. Rollins Cross
*Assistant Examiner*—Weilun Lo
*Attorney, Agent, or Firm*—Foley & Lardner

[57] ABSTRACT

A valve operating mechanism for a reciprocating internal combustion engine. The mechanism comprises a valve lifter made of fiber reinforced plastic and including a cylindrical section. A partition section is integrally connected to the cylindrical section and located perpendicular to the axis of the cylindrical section. The partition section has a lower side at which an end portion of the valve stem of an intake or exhaust valve is to be pushed. At least one coaxial annular shim engagement projection is formed at the upper side of the valve lifter partition section. Each projection is formed with coaxial two shim contacting surfaces. A generally disc-shaped shim is disposed on the upper side of the valve lifter partition section. The shim has an upper side in slidable contact with a cam, and a lower side in contact with the upper side of the valve lifter partition section. At least one lifter engagement groove is formed at the lower side of the shim. Each groove is defined between coaxial two lifter contacting surfaces of the shim. Each projection of the valve lifter partition section is in fitting engagement with each groove of the shim so that the shim contacting surfaces of the valve lifter are respectively in contact with the lifter contacting surfaces of the shim, thereby uniformalizing and distributing an applied load over wide contacting areas between the valve lifter and the shim.

12 Claims, 13 Drawing Sheets

FIG.15

Load resistance ability and motoring test results of shim engagement projections of FRP valve lifter (I)

| Sample | Comparative Example 1 | Comparative Example 2 | Example 1 | Example 2 | Example 3 | Example 4 | Example 5 | Example 6 |
|---|---|---|---|---|---|---|---|---|
| Crown section shape | Figs. 13A-14B | Having shim engagement projection(s) (similar to that in Figs. 3A,3B*3)) | Having shim engagement projection(s) (similar to that in Figs. 3A,3B*3)) | Having shim engagement projection(s) (similar to that in Figs. 3A,3B*3)) | Having shim engagement projection(s) (similar to that in Figs. 3A,3B*3)) | Having shim engagement projection(s) (similar to that in Figs. 3A,3B*3)) | Having shim engagement projection(s) (similar to that in Figs. 3A,3B*3)) | Having shim engagement projection(s) (similar to that in Figs. 3A,3B*3)) |
| 1/2 peripheral length of shim contacting surface(s) /outer peripheral length of valve lifter | 0 | 0.12 | 0.21 | 0.35 | 0.59 | 0.80 | 0.91 | 1.01 |
| Load resistance ability (Kgf) of shim engagement projection(s) at 150°C | 200 | 410 | 540 | 670 | 1050 | 1290 | 1320 | 1320 |
| Results of motoring test*2) | 16 samples /16 samples Broken | 2-4 samples /16 samples Cracked 3-6 samples /16 samples Broken | No abnormality | No abnormality | No abnormality | No abnormality | No abnormality | No abnormality |

Note 1
Main feature in shape of valve lifter
a) Outer diameter : 30mm
b) Bank section, thickness : 1.5mm, height : 1.5mm
c) Shim engagement projection, thickness : 3.0mm, height : 1.0mm Note 2
*2) High speed and long time durability test conditions
a) Engine : 1600cc (displacement) and 4 cylinder DOHC gasoline-fueled engine
b) Engine speed : 6000rpm
c) Time : 200hrs
d) Engine oil : SAE 7.5W-30
e) Oil temp. : 130°C Note 3
*3) Number of shim engagement projection(s) : 1 to 2 or more

FIG.16

| Load resistance ability and motoring test results of shim engagement projections of FRP valve lifter (II) | | | | | | |
|---|---|---|---|---|---|---|
| Sample | Comparative Example 3*5) | Example 7*5) | Example 8*5) | Example 9*5) | Comparative Example 4*6) | Example 10*6) |
| Crown section shape | Having shim engagement projection(s) (similar to that in Figs. 3A,3B*3)) | Having shim engagement projection(s) (similar to that in Figs. 3A,3B*3)) | Having shim engagement projection(s) (similar to that in Figs. 3A,3B*3)) | Having shim engagement projection(s) (similar to that in Figs. 3A,3B*3)) | Having shim engagement projection (Fig.9) | Having shim engagement projection (Fig.9) |
| 1/2 peripheral length of shim contacting surface(s) /outer peripheral length of valve lifter | 0.19 | 0.29 | 0.95 | 1.05 | 0.12 | 0.35 |
| Load resistance ability (Kgf) of shim engagement projection(s) at 150°C | 420 | 550 | 1160 | 1158 | 390 | 680 |
| Results of motoring test*2) (durability test conditions being same as those at Note 2 in TABLE 1) | 2-5 samples /16 samples Cracked 2-7 samples /16 samples Broken | No abnormality | No abnormality | No abnormality | 3-7 samples /16 samples Cracked 5-9 samples /16 samples Broken | No abnormality |
| Note 4 | Main feature in shape of valve lifter<br>a) Outer diameter : 30mm<br>b) Bank section, thickness : 1.5mm, height : 1.5mm<br>c) Shim engagement projection, thickness : *5) 1.5mm, height : 1.0mm<br>*6) 7.0mm, height : 1.0mm | | | | | |

FIG.17

Load resistance ability and motoring test results of shim engagement projections of FRP valve lifter (III)

| Sample | Comparative Example 5 | Comparative Example 6*8) | Example 11*8) | Comparative Example 7*9) | Example 12*9) | Example 13*9) | Example 14*9) |
|---|---|---|---|---|---|---|---|
| Crown section shape | Figs. 13A–14B | Having shim engagement projection (Fig.9) | Having shim engagement projection (Fig.9) | Having shim engagement projection(s) (similar to that in Figs. 3A,3B*3)) | Having shim engagement projection(s) (similar to that in Figs. 3A,3B*3)) | Having shim engagement projection(s) (similar to that in Figs. 3A,3B*3)) | Having shim engagement projection(s) (similar to that in Figs. 3A,3B*3)) |
| 1/2 peripheral length of shim contacting surface(s) /outer peripheral length of valve lifter | 0 | 0.10 | 0.54 | 0.13 | 0.20 | 0.89 | 0.97 |
| Load resistance ability (Kgf) of shim engagement projection(s) at 150°C | 210 | 380 | 940 | 430 | 550 | 1330 | 1340 |
| Results of motoring test*2) (durability test conditions being same as those at Note 2 in TABLE 1) | 16 samples /16 samples Broken | 2-6 Samples /16 samples Cracked 6-10 Samples /16 samples Broken | No abnormality | 1-4 Samples /16 Samples Cracked 2-5 Samples /16 Samples Broken | No abnormality | No abnormality | No abnormality |

Note 7
Main feature in shape of valve lifter
a) Outer diameter : 35mm
b) Bank section, thickness : 1.5mm, height : 1.5mm
c) Shim engagement projection, thickness : *8) 7.0mm, height : 1.0mm
*9) 3.0mm, height : 1.0mm

FIG. 18

| Load resistance ability and motoring test results of shim engagement projections of FRP valve lifter (IV) | | | | |
|---|---|---|---|---|
| Sample | Comparative Example 8 | Example 15 | Example 16 | Example 17 |
| Crown section shape | Having shim engagement projection(s) (similar to that in Figs. 3A,3B*3)) | Having shim engagement projection(s) (similar to that in Figs. 3A,3B*3)) | Having shim engagement projection(s) (similar to that in Figs. 3A,3B*3)) | Having shim engagement projection(s) (similar to that in Figs. 3A,3B*3)) |
| 1/2 peripheral length of shim contacting surface(s) /outer peripheral length of valve lifter | 0.21 | 0.27 | 0.93 | 1.02 |
| Load resistance ability (Kgf) of shim engagement projection(s) at 150°C | 460 | 540 | 1130 | 1140 |
| Results of motoring test*2) (durability test conditions being same as those at Note 2 in TABLE 1) | 1-6 samples /16 samples Cracked 2-5 samples /16 samples Broken | No abnormality | No abnormality | No abnormality |
| Note 10 | Main feature in shape of valve lifter<br>a) Outer diameter : 35mm<br>b) Bank section, thickness : 1.5mm, height : 1.5mm<br>c) Shim engagement projection, thickness : 1.5mm, height : 1.0mm | | | |

VALVE OPERATING MECHANISM INCLUDING VALVE LIFTER

BACKGROUND OF THE INVENTION

1. Field of the Invention

This invention relates to improvements in a valve operating mechanism for a reciprocating engine, and more particularly to a valve lifter in the mechanism which lifter is made of fiber reinforced plastic and which is high in strength and durability.

2. Description of the Prior Art

A reciprocating internal combustion engine is provided with a valve operating mechanism for operating intake and exhaust valves in timed relation to engine revolution. A variety of valve operating mechanisms have been proposed and put into practical use. One of them is of the directly operating type wherein the valve stem of the intake or exhaust valve is directly operated through a metallic valve lifter by a rotating cam. A shim is disposed between the cam and the valve lifter to prevent wear of the valve lifter.

In such a valve operating mechanism, the valve lifter is required to be light in weight and high in strength, and additionally high in wear resistance since the valve lifter slidably moves along the inner surface of a bore formed in a cylinder head. In view of this, carburized steel has been hetherto used as the material of the valve lifter from the viewpoint obtaining high strength and wear resistance. Additionally, aluminum alloy has also been used as the material of the valve lifter from the viewpoint of lightening the weight of the valve lifter.

Recently, decreasing the inertial mass of an engine valve operating system has been becoming an important theme, aimed at improving the power output of the engine under decreasing friction and increasing engine speed. Accordingly, it is required to reduce the weight of the valve lifter.

In view of the above, studies have been conducted in which the valve lifter is formed of fiber reinforced plastic (FRP) which is high in specific strength as compared with conventional metallic materials.

However, difficulties are encountred in using such a plastic valve lifter, because there is the possibility of the valve lifter being cracked or broken during use. Particularly, cracking and breaking tends to occur in a part against which the shim is pressed under the rotating action of the rotating cam.

SUMMARY OF THE INVENTION

It is an object of the present invention to provide an improved valve operating mechanism including a valve lifter made of fiber reinforced plastic, which valve lifter is high in durability and light in weight, meeting the requirements of modern reciprocating internal combustion engines.

Another object of the present invention is to provide an improved valve operating mechanism including a valve lifter made of fiber reinforced plastic, which valve lifter has a high load resistance ability, thereby preventing the valve lifter from cracking or breaking in use.

An aspect of the present invention resides in a valve operating mechanism including a valve lifter made of fiber reinforced plastic and with a cylindrical section. A partition section is connected to the cylindrical section and is located perpendicular to the axis of the cylindrical section. The partition section has a first side, and a second side at which an end portion of a valve stem of an engine valve is to be pushed. At least two shim contacting surfaces are defined at the first side of the valve lifter partition section. The shim contacting surfaces extend respectively along annular surfaces that are coaxial with the valve lifter cylindrical section. A generally disc-shaped shim is disposed on the first side of the valve lifter partition section. The shim has a first side in slidable contact with a cam, and a second side in contact with the first side of the valve lifter partition section. At least two lifter contacting surfaces are defined at the second side of the shim. The lifter contacting surfaces extend respectively along annular surfaces that are coaxial with the shim and in engagement respectively with the shim contacting surfaces of the valve lifter partition section.

Another aspect of the present invention resides in a valve lifter in cooperation with a shim. The valve lifter is made of fiber reinforced plastic and includes a cylindrical section, and a partition section connected to the cylindrical section. The partition section has a first side and a second side at which an end portion of a valve stem of an engine valve is pushed. At least two shim contacting surfaces are defined at the first side of the valve lifter partition section. Each shim contacting surface extends along an annular surface that is coaxial with the valve lifter cylindrical section. The shim is generally disc-shaped and disposed on the first side of the valve lifter partition section. The shim has a first side in slidable contact with a cam, and a second side in contact with the first side of the valve lifter partition section. The shim is formed with at least two lifter contacting surfaces at the second side of the shim. Each lifter contacting surface that is extends along an annular surface coaxial with the shim. The lifter contacting surfaces are in engagement respectively with the shim contacting surfaces of the valve lifter partition section.

Thus, the valve lifter and the shim are engaged with each other through at least two shim contacting surfaces on the valve lifter side and at least two lifter contacting surfaces on the shim side. Accordingly, load applied from the cam through the shim to the valve lifter is uniform and dispersed over the contacting surfaces which are considerably increased, thereby largely improving a load resistance ability of the valve lifter. This allows the valve lifter to be formed of fiber reinforced plastic which is high in specific strength, thereby rendering the valve lifter to be durable throughout a long period of use without causing cracking and breaking thereof. Since the valve lifter is lighter in weight due to the use of the plastic, and the load applied to an outer peripheral wall thereof is reduced, it is made possible that the outer peripheral wall of the valve lifter is reduced in thickness or otherwise omitted. This allows the shim to have a larger diameter and the valve lifter to have a smaller outer diameter, thus enabling the valve lifter to be lighter in weight with an increased freedom in its design. Thus, the weight-lightening of the valve lifter in design and material can effectively lead to a sharp reduction in the inertial mass of an engine valve operating system, thereby achieving an engine power output improvement due to increased engine speed.

BRIEF DESCRIPTION OF THE DRAWINGS

In the drawings, like reference numerals designate like elements and parts throughout all figures, in which:

FIG. 15 is a table showing load resistance ability and motoring test results of shim engagement projections of FRP valve lifter (I);

FIG. 16 is a table showing load resistance ability and motoring test results of shim engagement projections of FRP valve lifter (II);

FIG. 17 is a table showing load resistance ability and motoring test results of shim engagement projections of FRP valve lifter (III);

FIG. 18 is a table showing load resistance ability and motoring test results of shim engagement projections of FRP valve lifter (IV).

DETAILED DESCRIPTION OF THE INVENTION

Figure 1:
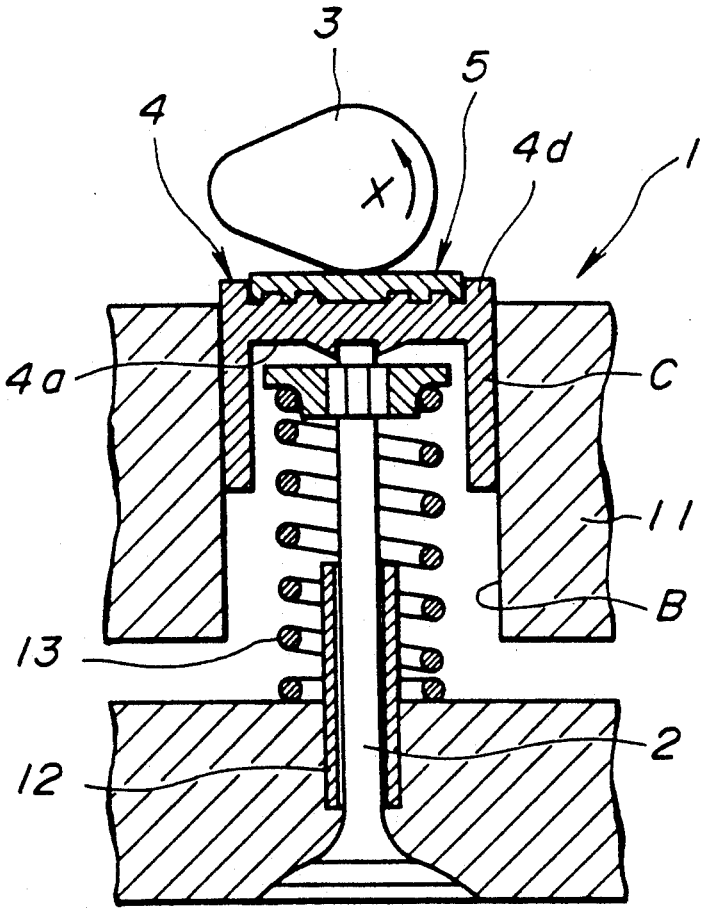
FIG. 1 is a vertical sectional view of an embodiment of a valve operating mechanism according to the present invention.

Referring now to FIG. 1 of the drawings, an embodiment of a valve operating mechanism according to the present invention is illustrated by the reference numeral 1. The valve operating mechanism 1 in this embodiment is for a reciprocating internal combustion engine (not shown) and is arranged to directly operate an engine valve 2 such as intake or exhaust valve. The valve operating mechanism 1 comprises a valve lifter 4 which is interposed between a cam 3 of a camshaft and the valve 2. Additionally, a shim 5 is fittingly disposed on the crown section of the valve lifter 4 so as to be in slidable contact with the cam 3. Accordingly, when the cam 3 rotates in the direction of an arrow X so that the cam nose section comes in contact with the shim 5 upon being in slidable contact with the shim 5, the valve lifter 4 with the shim 5 moves downward along the inner surface of a bore B formed in a cylinder head 11 of the engine thereby causing the valve 2 to move downward along a valve guide 12 so that the valve 2 is opened. When the cam nose section of the cam 3 has contacted with and gone away from the surface of the shim 5, the valve 2 moves upward under the biasing force of a spring 13 thereby closing the valve 2.

The shim 5 is provided to prevent the top of the valve lifter 4 from being worn due to sliding contact with the cam 3. The valve lifter 4 is connected to the top end portion of the stem of the valve 2 in a manner to be rotatable around the axis of the valve 2 and slidable along the inner peripheral surface of the bore B of the cylinder head 11.

The valve lifter 4 and the shim 5 will be further discussed in detail with reference to FIGS. 2A to 3B.

The valve lifter 4 is generally cylindrical and has a cylindrical section C which is slidably movably disposed in the bore B of the cylinder head 11. The valve lifter 4 has a generally disc-shaped partition section 4*a* which is integral with the cylindrical section C and located inside the cylindrical section C in such a manner that the axis of the cylindrical section C is perpendicular to the partition section 4*a*. The partition section 4*a* is formed at its upper side with a shim disposing surface 4*b* on which the shim 5 is disposed, being formed at its lower side with a valve stem end portion pushing section 4*c* by which the valve stem of the valve 2 is pushed downward. The top end portion of the valve stem is securely connected to the pushing section 4*c*. An upper part of the cylindrical section C of the valve lifter 4 relative to the partition section 4*a* serves as a bank section (projection) 4*d* for engagement with the shim 5, while a lower part of the cylinder section C relative to the partition section 4*a* serves as a skirt section 4*e* extending along the inner peripheral surface of the cylinder head bore B.

The partition section 4*a* is formed on its shim disposing surface 4*b* with two annular and coaxial shim engagement projections 4*f*, 4*g* which protrude upwardly or axially relative to the cylindrical section C. The projection 4*f* is located inside and separate from the projection 4*g*. The projection 4*g* is coaxial with and located inside the shim engagement bank section 4*d*, and separate from the shim engagement bank section 4*d*. The projection 4*f* is formed with generally cylindrical inner and outer shim contacting surfaces 4*f*-A, 4*f*-B to which parts of the shim 5 are respectively contactable. The shim contacting surface 4*f*-A, 4*f*-B are coaxial and extend generally axial with respect to the cylindrical section C. The projection 4*g* is formed with generally cylindrical inner and outer shim contacting surfaces 4*g*-A, 4*g*-B to which parts of the shim 5 are respectively contactable. The shim contacting surfaces 4*g*-A, 4*g*-B are coaxial and extend generally axially with respect to the cylindrical section C. The shim engagement bank section 4*d* is formed with a generally cylindrical shim contacting surface 4*d*-A which extends generally axial with respect to the cylindrical section C.

The valve lifter 4 of the above structure is formed of fiber reinforced plastic (FRP) which is, for example, a so-called super engineering plastic containing fiber as reinforcing fiber. Examples of the super engineering plastic are polyimide (PI) resin, and polyether sulfone (PES) resin. Examples of the fiber are carbon fiber, and glass fiber. The content of the fiber is preferably within a range of from 30 to 50% by weight relative to the plastic, from the viewpoints of moldability and physical properties.

The shim 5 is generally disc-shaped and formed at its lower side or surface (contactable with the partition section shim disposing surface 4*b* of the valve lifter 4) with two annular coaxial grooves 5*f*, 5*g* which are depressed upwardly and axially relative to the shim 5. The groove 5*f* is located inside and separate from the groove 5*g*. The groove 5*f* is defined between generally cylindrical inner and outer lifter contacting surfaces 5*f*-A, 5*f*-B to which parts of the valve lifer 4 are respectively contactable. The groove 5*g* is defined between generally cylindrical inner and outer lifter contacting surfaces 5*g*-A, 5*g*-B to which parts of the valve lifter 4 are respectively contactable. The shim 5 is formed with a generally cylindrical peripheral surface which serves as a further lifter contacting surface 5-A to which a part of the valve lifter 4 is contactable. The lifter contacting surface 5-A is located outside and separate from the outer lifter contacting surface 5*g*-B. The shim 5 is formed of steel.

In this embodiment, the height (or axial length) of each projection 4*f*, 4*g* of the valve lifter 4 is preferably between 0.5 mm and a value of the height of the shim engagement bank section 4*d* from the viewpoint of rounding or chamfering the peripheral corner portions of each projection 4*f*, 4*g*. It will be understood that it is preferable that the peripheral corner portions are rounded or chamfered as much as possible.

Figure 2A:
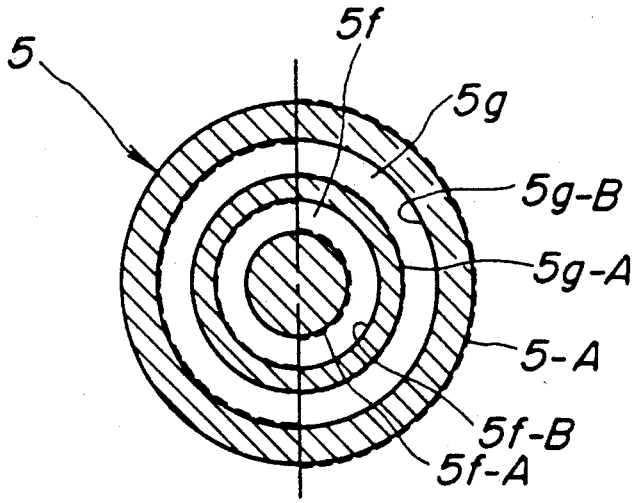
FIG. 2A is a plan view of a shim used in the valve operating mechanism of FIG. 1, as viewed from the direction of an arrow 2A of FIG. 2B.
Figure 2B:
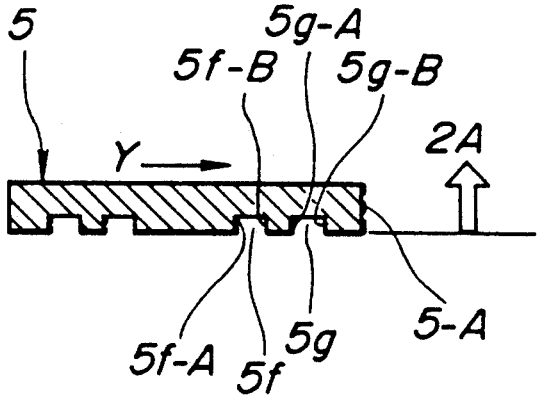
FIG. 2B is a vertical sectional view of the shim of FIG. 2A.
Figure 3A:
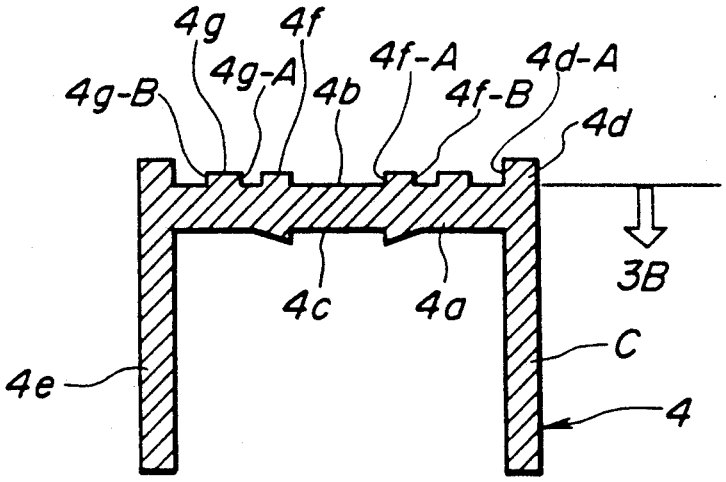
FIG. 3A is a vertical sectional view of a valve lifter used in the valve operating mechanism of FIG. 1.
Figure 3B:
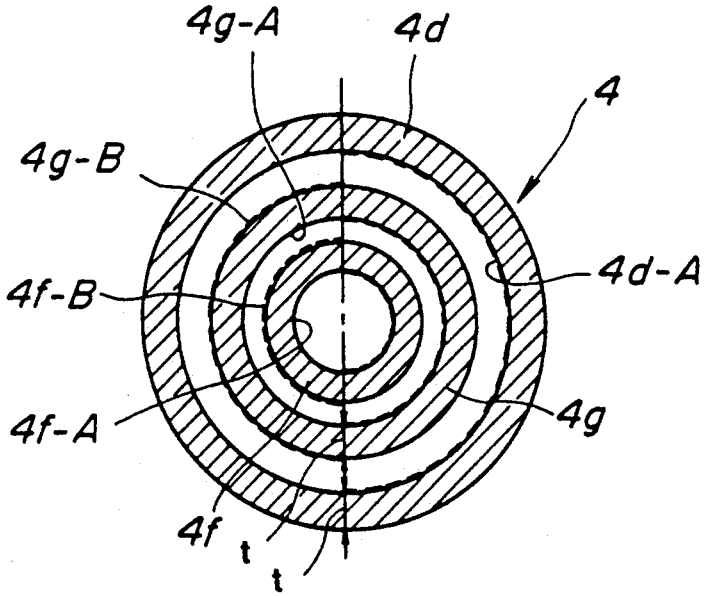
FIG. 3B is a plan view of the valve lifter as viewed from the direction of an arrow 3B in FIG. 3A.

In a state wherein the shim 5 is disposed on the partition section 4*a* of the valve lifter 4, the annular coaxial projections 4*f*, 4*g* of the valve lifter partition section 4*a* are respectively fitted in the annular coaxial grooves 5*f*, 5*g* of the shim 5. In this state, the contacting surfaces 4*f*-A, 4*f*-B of the valve lifter partition section projection 4*f* is in contact respectively with the contacting surfaces 5*f*-A, 5*f*-B of the shim 5, while the contacting surfaces 4*g*-A, 4*g*-B of the valve lifter partition section projection 4*g* is in contact respectively with the contacting surface 5*g*-A, 5*g*-B of the shim 5. Accordingly, when the cam 3 rotates in the direction of the arrow X as shown in FIG. 1 and the cam nose section comes into contact with the shim 5 so that the shim 5 receives a force in the direction indicated by an arrow Y in FIG. 2B, the contacting surfaces 5*f*-B, 5*g*-B of the shim 5 at the left side relative to the center line (not identified) in FIG. 2A are respectively forcibly brought into engagement with the contacting surfaces 4*f*-B, 4*g*-B of the valve lifter 4 at the left side relative to the center line (not identified) in FIG. 3B, as indicated by broken lines in FIGS. 2A and 3B. Simultaneously, the contacting surfaces 5*f*-A, 5*g*-A of the shim 5 at the right side relative to the center line in FIG. 2A are respectively forcibly brought into engagement with the contacting surfaces 4*f*-A, 4*g*-A of the valve lifter 4 at the left side relative to the center line in FIG. 3B, as indicated by broken lines in FIGS. 2A and 3B. At this time, the contacting surface 5-A of the shim 5 at the right side relative to the center line in FIG. 2A is forcibly brought into engagement with the contacting surface 4*d*-A of the shim engagement bank section 4*d* at the right side relative to the center line in FIG. 3B, as indicated in a dotted line in FIGS. 2A and 3B.

Thus, according to the above embodiment, the contacting area between the valve lifter partition section 4*a* and the shim 5 is considerably large, and therefore load applied to the valve lifter partition section 4*a* from the metal shim 5 is very small per unit area. This allows the valve lifter formed of the fiber reinforced plastic to obtain a high load resistance ability which is not inferior as compared with that of conventional metallic valve lifters.

Figure 4:
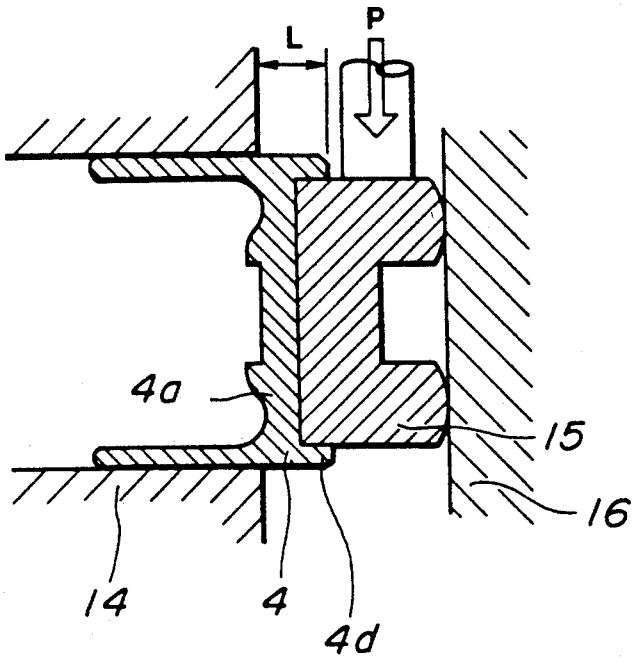
FIG. 4 is a vertical sectional view showing a manner of measuring the strength of coaxial projections formed in valve lifters according to the present invention.

Next, a study was made concerning the strength of the shim engagement projections 4*f*, 4*g* and 4*d* (bank section) of the valve lifter 4 obtaining the measurement of the strength using a measurement manner as shown in FIG. 4. In this measurement manner, the valve lifter 4 was located lateral and fixed in place by a fixing jig 14 so that the shim disposing surface 4*b* of the valve lifter partition section 4*a* was located vertically. The valve lifter 4 projected by L(=5 mm) from the fixing jig 14. A pushing or load applying jig 15 was fit in a depression located inside the annular shim engagement bank section 4*d* so that the end section of the pushing jig 15 was engaged with the shim disposing surface 4*b* of the valve lifter partition section 4*a*. The end section of the pushing jig 15 has the same shape as that of the lower surface (facing the shim disposing surface 4*b* of the valve lifter partition section 4*a*) of the shim 5. Another fixing jig 16 was provided to allow the pushing jig 15 to slide therethrough. In FIG. 4, a load W was applied to the projections 4*f*, 4*g*, 4*d* in the direction of an arrow P by the pushing jig 15 until each projection 4*f*, 4*g*, 4*d* was broken, thereby obtaining a load resistance ability (kgf).

Figure 5:
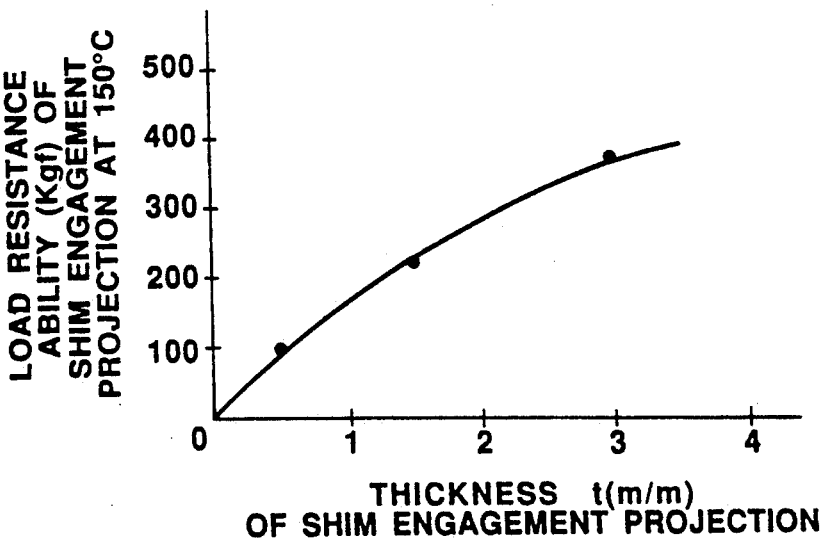
FIG. 5 is a graph showing the relationship between load resistance ability at 150° C. and thickness of the projections in the valve lifter.

FIG. 5 shows results of the measurements of the load resistance ability (kgf) at 150° C. of the annular projections 4*f*, 4*g*, 4*d* with respect to a changing of the thickness of the annular projection. The results of FIG. 5 demonstrate that the increasing rate of the load resistance ability decreases as the thickness (t in FIG. 3A) of the projections 4*f*, 4*g*, 4*d* increases.

According to the observation of the broken states of the shim engagement bank section 4*d* of the valve lifter 4 in the above measurements, a ½ peripheral length (l in FIG. 6B) of the shim engagement bank section 4*d* was broken, which demonstrated that the load resistance ability is lowered in the case of increasing the ½ peripheral length of the shim engagement bank section relative to the constant outer peripheral length of the bank section.

Figure 6A:
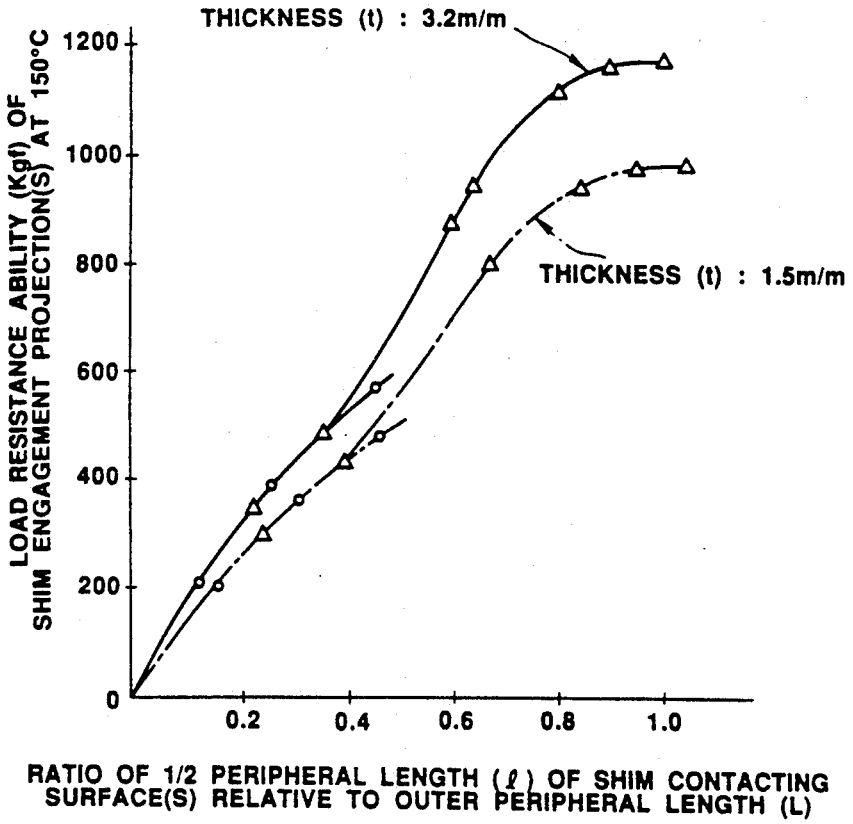
FIG. 6A is a graph showing the relationship between load resistance ability at 150° C. and the ratio of a ½ peripheral length of shim contacting surface(s) relative to the outer peripheral length of the valve lifter, measured by changing the thickness of the projections.
Figure 6B:
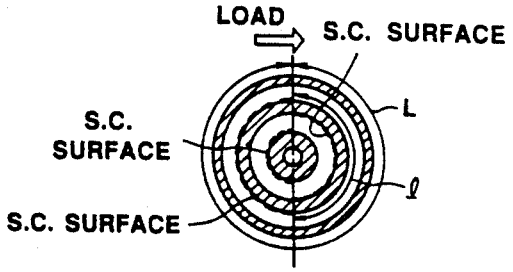
FIG. 6B is a vertical sectional view of a valve lifter, showing shim contacting surfaces, l (½ peripheral length of a shim contacting surface), and L (outer peripheral length)

In this regard, measurements were conducted to obtain the results shown in FIG. 6A, in which the load resistance ability (kgf) at 150° C. was measured upon varying the ratio of the ½ peripheral length (l in FIG. 6B) of the shim contacting surface(s) of the shim engagement projection(s) of the valve lifter partition section 4*a* relative to an outer peripheral or circumferential length (L in FIG. 6B) of the valve lifter (having an outer diameter of 30 mm). This ratio was represented by a formula of [½ peripheral length (l) of the shim contacting surface(s)/the outer peripheral length (L) of the valve lifter]. Additionally, in the measurements, two measurement manners were employed, one of which was to push one shim contacting surface of one shim engagement projection by the pushing jig 15, and the other was to push two shim contacting surfaces of respective two shim engagement projections. The results of the former measurement manner were indicated by Δ in FIG. 6A, while the results of the latter measurement manner was indicated by ∘ in FIG. 6A. Additionally, in the measurements, two kinds of thickness (t) of the shim engagement projection(s) were employed, in which one of these was 1.5 mm (or 1.5±0.2 mm), and the other was 3.2 mm (or 2.5 mm or more) as shown in FIG. 6A.

As shown in the FIG. 6A, in case where one shim contacting surface was pushed by the pushing jig 15, it was confirmed that the load resistance ability was relatively low. On the contrary, in case where two shim contacting surfaces were pushed by the pushing jig 15, it was confirmed that the load resistance ability abruptly increased within a range between 0.35 and 0.40 of the ratio of the ½ peripheral length of the shim contacting surface(s) relative to the outer peripheral length of the valve lifter.

The above measurement of the load resistance ability was carried out for valve lifters made of the fiber reinforced plastic, of Examples 1 to 17 (according to the present invention) and Comparative Examples 1 to 8 (outside the scope of the present invention) which are shown in FIGS. 15–18. In FIGS. 15–18, results of motoring tests are also shown. The motoring tests were conducted on an engine in which the valve lifters of each of the Examples or of the Comparative Examples were installed in position. The valve lifters 4' and the shims 5' of Comparative Examples 1 and 5 were of the shapes shown in FIGS. 13A, 13B, 14A and 14B, in which the valve lifter 4' was formed with the shim engagement bank section **4*d'* but with no shim engagement projection at the partition section 4*a'* so that the shim disposing surface 4*b'* is flat. Additionally, the shim 5' was disc-shaped and formed with no lifter engagement groove so that the lower surface (facing the shim disposing surface 4*b'*) of the shim 5'** is flat.

As appreciated from the above, the valve lifters of Comparative Examples 1 and 5 had a load resistance ability of only about 200 kgf. Additionally, the whole bank section **4*d'* of each Comparative Example valve lifter was broken. On the contrary, in the case wherein the shim engagement projections 4*f*, 4*g* were provided at the shim disposing surface 4*b* of the crown section of the valve lifter 4 while the grooves 5*f*, 5*g* were provided in the shim 5 for the projections, the load resistance ability of the shim engagement projections were considerably improved; however, crack and breakage were made in the shim engagement projections under the motoring test, under conditions in which the ratio of the ½ peripheral length (l) of the shim contacting surface of the projections 4*f*, 4*g* relative to the outer peripheral length (L) of the valve lifter 4** was within a range of from 0.10 to 0.21.

Under conditions in which the above ratio fell into a range of from 0.20 to 1.05, the load resistance ability was improved to a value ranging from 540 to 1,340 kgf, in which no abnormality was observed even under the motoring test. As will be understood from FIG. 6A, under conditions in which the above ratio exceeded a value of 0.90, no change could be found in load resistance ability. The reasons for this seems to be as follows: When load over a predetermined level is applied to the shim engagement projections, the load resistance ability depends upon that of a local portion (the central location of load applied) of the shim engagement projections, rather than the size of the ½ peripheral length of the shim contacting surface(s). Thus, it seems that in this ratio range the load resistance ability is independent of the size of the ½ peripheral length of the shim contacting surface, and therefore no further improvement is made in load resistance ability. It will be seen that the shim engagement projections are practically broken under conditions in which the ratio is less than 0.20.

Thus, it has been confirmed that the ratio of the ½ peripheral length (l) of the shim contacting surface(s) is preferably within a range of from 0.20 to 0.90, more preferably 0.27 to 0.90. Additionally, it is preferable in practice that the outer diameter of the valve lifter 4 is not larger than 35 mm.

Figure 7:
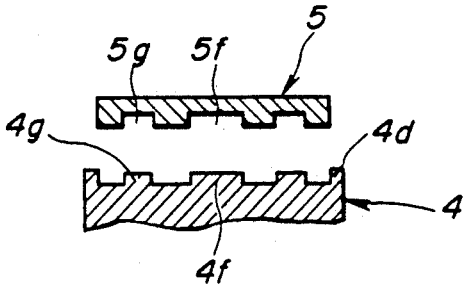
FIG. 7 is a fragmentary vertical sectional view of a first modified example of an arrangement including the valve lifter and the shim.

FIG. 7 illustrates a first modified example of an arrangement of the valve lifter 4 and the shim 5, which is similar to that of FIGS. 2A to 3B. In this arrangement, the coaxial projection **4*g* of the valve lifter 4 is not annular or may be arcuate. In connection with this, the coaxial groove 5*g*** is not annular or may be arcuate.

Figure 8:
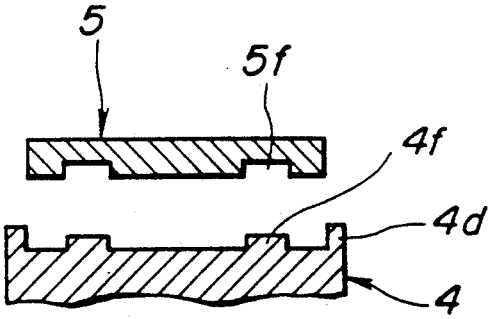
FIG. 8 is a view similar to FIG. 7 but showing a second modified example of the arrangement.

FIG. 8 illustrates a second modified example of the arrangement of the valve lifter 4 and the shim 5, which is similar to that of FIGS. 2A to 3B. In this arrangement, the valve lifter 4 is formed with only one coaxial annular projection **4*f*. In connection with this, the shim 5 is formed with only one coaxial annular groove 5*f***.

Figure 9:
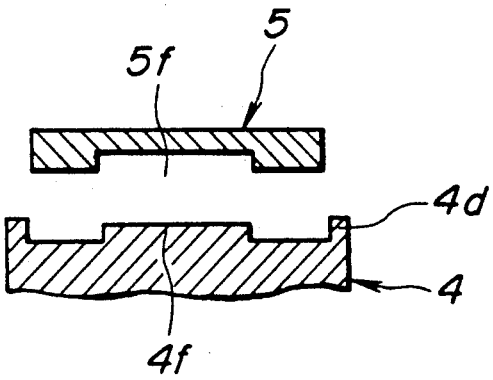
FIG. 9 is a view similar to FIG. 7 but showing a third modified example of the arrangement.

FIG. 9 illustrates a third modified example of the arrangement of the valve lifter 4 and the shim 5, which is similar to that of FIGS. 2A to 3B. In this arrangement, the valve lifter 4 is formed with only one coaxial circular projection **4*f*. In connection with this, the shim 5 is formed with only one coaxial circular groove 5*f***.

Figure 10:
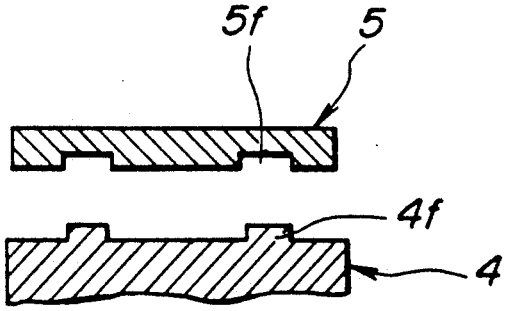
FIG. 10 is a view similar to FIG. 7 but showing a fourth modified example of the arrangement.

FIG. 10 illustrates a fourth modified example of the arrangement of the valve lifter 5 and the shim 5, which is similar to that of FIGS. 2A to 3B. In this arrangement, the valve lifter 4 is formed with only one coaxial annular projection **4*f*. In connection with this, the shim 5 is formed with only one coaxial annular groove 5*f*. No shim engagement bank section 4*d* is formed in the valve lifter 5**.

Figure 11:
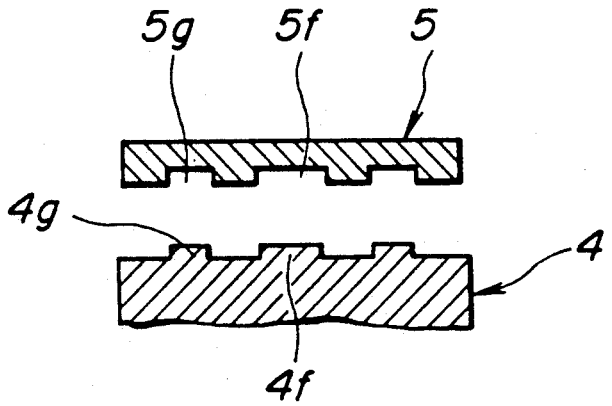
FIG. 11 is a view similar to FIG. 7 but showing a fifth modified example of the arrangement.

FIG. 11 illustrates a fifth modified example of the arrangement of the valve lifter 4 and the shim 5, which is similar to that of FIGS. 2A to 3B. In this arrangement, the valve lifter 4 is formed with the coaxial annular projection **4*g* and the circular projection 4*f*. In connection with this, the shim 5 is formed with the coaxial annular groove 5*g* and the circular groove 5*f*. No shim engagement bank section is formed in the valve lifter 4**.

Figure 12:
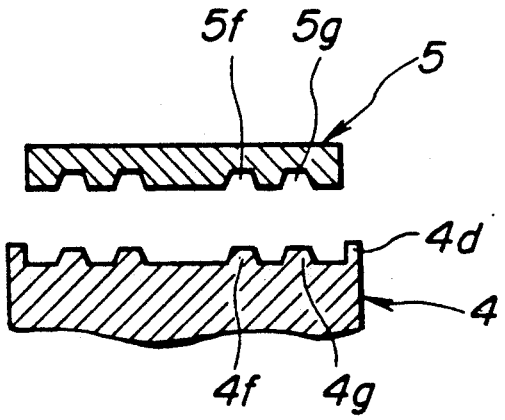
FIG. 12 is a view similar to FIG. 7 but showing a sixth modified example of the arrangement.
Figure 13A:
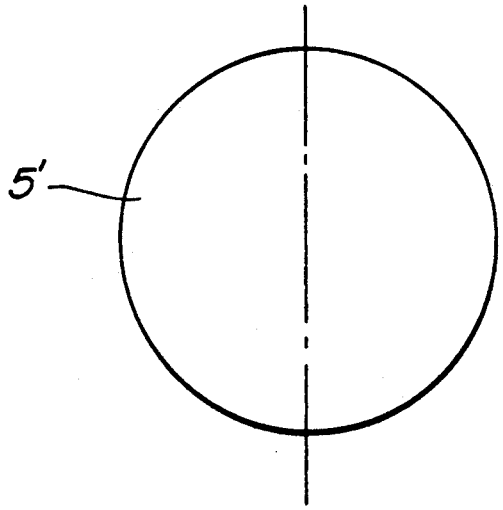
FIG. 13A is a plan view of a shim forming part of an arrangement of Comparative Example 1, as viewed from the direction of an arrow 13A of FIG. 13B.
Figure 13B:
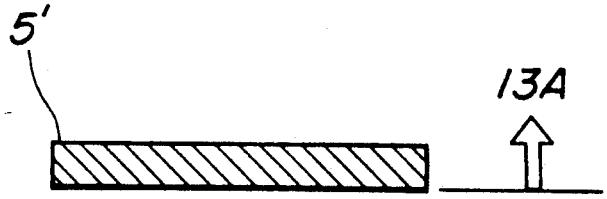
FIG. 13B is a vertical sectional view of the shim of FIG. 13A.
Figure 14A:
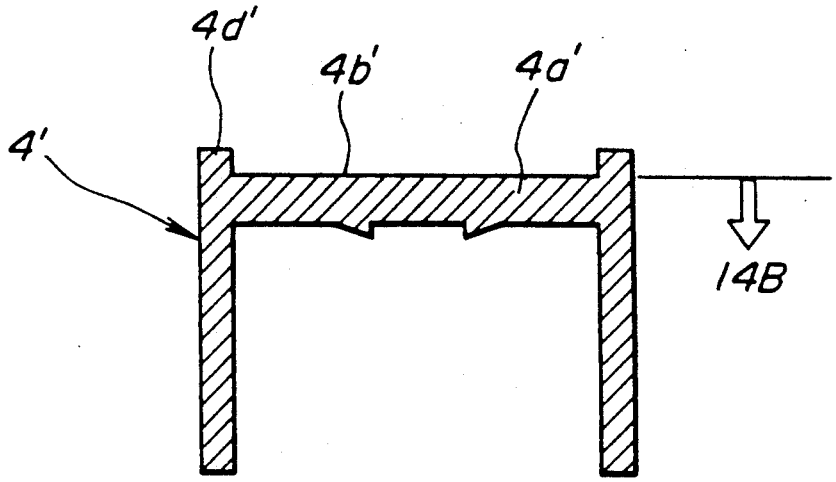
FIG. 14A is a vertical sectional view of a valve lifter forming part of the arrangement of Comparative Example 1.
Figure 14B:
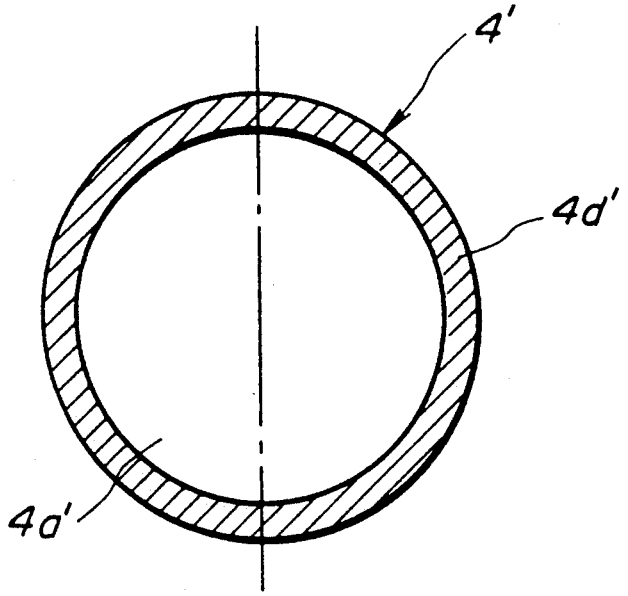
FIG. 14B is a plan view of the valve lifter of FIG. 14A as viewed from the direction of an arrow 14B of FIG. 14A.

FIG. 12 illustrates a sixth modified example of the arrangement of the valve lifter 4 and the shim 5. This arrangement is similar to the embodiment of FIGS. 2A to 3B, in which each of the shim contacting surfaces of each projection **4*f*, 4*g* of the valve lifter 4 is inclined in vertical cross-section relative to a plane (not shown) which extends axially of the valve lifter 4. Similarly, each of the lifter contacting surfaces of each groove 5*f*, 5*g* of the shim 5 is inclined in vertical cross-section. Accordingly, replacement of the shim 5** can be facilitated.

While the valve lifter 4 and the shim 5 have been shown and described as being formed respectively with at least one coaxial projection **4*f*, 4*g* and at least one coaxial groove 5*f*, 5*g* which are fittable with each other, it will be understood that the relationship in projection and groove may be reversed from the above so that the valve lifter 4 is formed with at least one groove (5*f*, 5*g***)

while the shim 5 is formed with at least one projection (4*f*, 4*g*).

What is claimed is:

1. A valve operating mechanism comprising:

a valve lifter made of fiber reinforced plastic and including a cylindrical section, and a partition section connected to said cylindrical section and located perpendicular to the axis of said cylindrical section, said partition section having a first side, and a second side at which an end portion of a valve stem of an engine valve is to be pushed;

means defining at least one shim contacting surface at said first side of said valve lifter partition section, said shim contacting surface extending along an annular surface coaxial with said valve lifter cylindrical section;

a generally disc-shaped shim disposed on said first side of said valve lifter partition section, said shim having a first side in slidable contact with a cam, and a second side in contact with said first side of said valve lifter partition section; and means defining at least one lifter contacting surface at said second side of said shim, said lifter contacting surface extending along an annular surface coaxial with said shim and in engagement with said shim contacting surface of said valve lifter partition section.

2. A valve operating mechanism as claimed in claim 1, wherein a ratio of a ½ peripheral length of said at least one shim contacting surface relative to an outer peripheral length of said valve lifter cylindrical section is within a range of from 0.20 to 0.90.

3. A valve operating mechanism comprising:

a valve lifter made of fiber reinforced plastic and including a cylindrical section, and a partition section connected to said cylindrical section and located perpendicular to the axis of said cylindrical section, said partition section having a first side, and a second side at which an end portion of a valve stem of an engine valve is to be pushed;

means defining at least two shim contacting surfaces at said first side of said valve lifter partition section, said shim contacting surfaces respectively extending along annular surfaces coaxial with said valve lifter cylindrical section;

a generally disc-shaped shim disposed on said first side of said valve lifter partition section, said shim having a first side in slidable contact with a cam, and a second side in contact with said first side of said valve lifter partition section; and means defining at least two lifter contacting surfaces at said second side of said shim, said lifter contacting surfaces respectively extending along annular surfaces coaxial with said shim and in engagement respectively with said shim contacting surfaces of said valve lifter partition section.

4. A valve operating mechanism as claimed in claim 3, wherein a ratio of total of ½ peripheral lengths of said shim contacting surfaces relative to an outer peripheral length of said valve lifter cylindrical section is within a range of from 0.20 to 0.90.

5. A valve operating mechanism as claimed in claim 3, wherein said shim is made of steel.

6. A valve operating mechanism as claimed in claim 3, wherein each of said shim contacting surfaces and each of said lifter contacting surfaces extend along the axis of said valve lifter cylindrical section.

7. A valve operating mechanism as claimed in claim 3, wherein said valve lifter cylindrical section has an outer diameter not larger than 35 mm.

8. A valve operating mechanism as claimed in claim 3, wherein said valve lifter partition section is integrally connected with said valve lifter cylindrical section.

9. A valve operating mechanism as claimed in claim 3, wherein said valve operating mechanism is for a reciprocating internal combustion engine.

10. A valve operating mechanism as claimed in claim 8, wherein said valve lifter is slidably movably disposed in a bore formed in a cylinder head of the engine.

11. A valve lifter in cooperation with a shim, comprising:

a valve lifter made of fiber reinforced plastic and including a cylindrical section, and a partition section connected to said cylindrical section and located perpendicular to the axis of said cylindrical section, said partition section having a first side, and a second side at which an end portion of a valve stem of an engine valve is to be pushed; and means defining at least one shim contacting surface at said first side of said valve lifter partition section, said shim contacting surface extending along an annular surface coaxial with said valve lifter cylindrical section;

said shim being generally disc-shaped and disposed on said first side of said valve lifter partition section, said shim having a first side in slidable contact with a cam, and a second side in contact with said first side of said valve lifter partition section, said shim including means defining at least one lifter contacting surface at said second side of said shim, said lifter contacting surface extending along an annular surface coaxial with said shim and in engagement with said shim contacting surface of said valve lifter partition section.

12. A valve lifter as claimed in claim 11, wherein said at least one shim contacting surface defining means includes means defining at least two shim contacting surfaces each of which extends along the coaxial annular surface, and said lifter contacting surface defining means includes means defining at least two lifter contacting surfaces each of which extends along the coaxial annular surface, wherein said lifter contacting surfaces are respectively in contact with said shim contacting surfaces.

* * * * *